US009289990B2

(12) United States Patent
Machida et al.

(10) Patent No.: US 9,289,990 B2
(45) Date of Patent: Mar. 22, 2016

(54) INKJET HEAD

(71) Applicant: Konica Minolta, Inc., Chiyoda-ku, Tokyo (JP)

(72) Inventors: Yuichi Machida, Hachioji (JP); Kusunoki Higashino, Osaka (JP)

(73) Assignee: KONICA MINOLTA, INC. (JP)

( * ) Notice: Subject to any disclaimer, the term of this patent is extended or adjusted under 35 U.S.C. 154(b) by 0 days.

(21) Appl. No.: 14/647,708

(22) PCT Filed: Oct. 22, 2013

(86) PCT No.: PCT/JP2013/078580

§ 371 (c)(1),
(2) Date: May 27, 2015

(87) PCT Pub. No.: WO2014/083971

PCT Pub. Date: Jun. 5, 2014

(65) Prior Publication Data

US 2015/0306876 A1 Oct. 29, 2015

(30) Foreign Application Priority Data

Nov. 27, 2012 (JP) ..... 2012-258416

(51) Int. Cl.
*B41J 2/045* (2006.01)
*B41J 2/14* (2006.01)

(52) U.S. Cl.
CPC ..... *B41J 2/14298* (2013.01); *B41J 2/14201* (2013.01); *B41J 2/14233* (2013.01)

(58) Field of Classification Search
CPC ..... B41J 2/14201; B41J 2/14233; B41J 2/14274; B41J 2/14298
See application file for complete search history.

(56) References Cited

U.S. PATENT DOCUMENTS 7,290,866 B2 * 11/2007 Sugahara ..... B41J 2/14233 347/68

FOREIGN PATENT DOCUMENTS

JP 5-162311 * 6/1993 ..... B41J 2/045
JP 05229115 A 9/1993
JP 2002248765 A 9/2002

(Continued)

OTHER PUBLICATIONS

International Search Report corresponding to Application no. PCT/JP2013/078580; Date of Mailing: Nov. 26, 2013, with English translation.

*Primary Examiner* — Geoffrey Mruk
(74) *Attorney, Agent, or Firm* — Cantor Colburn LLP

(57) ABSTRACT

An inkjet head may include a nozzle hole; a pressure chamber; and a piezoelectric device disposed on the side opposite to the nozzle hole. A cross-sectional shape of the pressure chamber may include a circular-arc-shaped side wall portion and linear side wall portions connected with two ends of the circular-arc-shaped side wall portion on the side opposite to the supply side, the distance between the linear side wall portions gradually decreasing toward the side opposite to the supply side. The piezoelectric device may include a displacement portion that causes the pressure change inside the pressure chamber, and an electrode connection portion electrically connecting the piezoelectric device and an electrode. A cross-sectional shape of the displacement portion may include a circular-arc-shaped portion and has a smaller cross section than a corresponding cross section of the shape formed by the circular-arc-shaped side portion.

20 Claims, 8 Drawing Sheets

(56) References Cited

FOREIGN PATENT DOCUMENTS

| | | | |
|---|---|---|---|
| JP | 2005059328 | A | 3/2005 |
| JP | 2005096438 | A | 4/2005 |
| WO | 2011142256 | A1 | 11/2011 |

* cited by examiner

FIG. 8

| | PRESENCE/ABSENCE OF ELECTRODE CONNECTION PORTION | DRIVING VOLTAGE | STRESS |
|---|---|---|---|
| PRESENT INVENTION | PRESENCE | 1.00 | 1.00 |
| SQUARE | ABSENCE | 1.12 | – |
| CIRCLE | ABSENCE | 1.00 | – |
| SQUARE | PRESENCE | 1.12 | 1.12 |
| CIRCLE | PRESENCE | 1.14 | 1.81 |

INKJET HEAD

CROSS REFERENCE TO RELATED APPLICATIONS

This is the U.S. national stage of application No. PCT/JP2013/078580, filed on Oct. 22, 2013. Priority under 35 U.S.C. §119(a) and 35 U.S.C. §365(b) is claimed from Japanese Application No. 2012-258416, filed Nov. 27, 2012, the disclosure of which is also incorporated herein by reference.

TECHNICAL FIELD

The present invention relates to an inkjet head.

BACKGROUND ART

In response to demands for higher accuracy of image formation and higher speed of printing executed by an inkjet recording apparatus, there has been proposed a one-pass drawing system which uses line heads each containing a plurality of inkjet heads arranged in a zigzag shape to perform drawing only by conveyance of a recording medium. Each of the inkjet heads constituting the line heads contains a channel from which ink is ejected. For size reduction and two-dimensional and highly dense positioning of a plurality of channels of the respective inkjet heads, a method currently proposed arranges the channels in a zigzag shape (e.g., refer to Patent Literature 1).

There has been further proposed a structure which draws an upper portion of a piezoelectric device included in a small-sized channel for extraction of an electrode, forming such a shape that the piezoelectric device extends over a pressure chamber (e.g., refer to Patent Literature 2).

CITATION LIST

Patent Literatures

Patent Literature 1: JP 5-229115 A
Patent Literature 2: JP 2002-248765 A

SUMMARY OF INVENTION

Technical Problem

According to Patent Literature 2, a connection portion between the piezoelectric device and the electrode is positioned on a side wall of the pressure chamber. This structure offers an advantage of higher durability against pressure applied for connection between the piezoelectric device and the electrode. However, this structure may inhibit displacement of the piezoelectric device, or converge stress to an area around the boundary between the displacement portion and the connection portion to such a level as to cause fatigue fracture by drive of the piezoelectric device.

The present invention has been developed to solve the above problems. It is an object of the present invention to provide an inkjet head capable of improving drive efficiency of a piezoelectric device while reducing fracture fatigue of the piezoelectric device.

Solution to Problem

In order to solve the above problems, an invention of claim 1 is an inkjet head including: a nozzle hole through which droplets are ejected; a pressure chamber so provided as to communicate with the nozzle hole; and a piezoelectric device disposed on the side opposite to the nozzle hole, and causing a pressure change inside the pressure chamber, wherein a cross-sectional shape of the pressure chamber in a direction substantially perpendicular to an arrangement direction where the pressure chamber and the piezoelectric device are arranged includes a circular-arc-shaped side wall portion that has a substantially circular-arc shape on the supply side for liquid supply to the pressure chamber, and linear side wall portions connected with two ends of the circular-arc-shaped side wall portion on the side opposite to the supply side, and forming such a shape that the distance between the linear side wall portions gradually decreases toward the side opposite to the supply side, the piezoelectric device includes a displacement portion that causes the pressure change inside the pressure chamber by displacement of the piezoelectric device, and an electrode connection portion electrically connecting the piezoelectric device and an electrode, a cross-sectional shape of the displacement portion in the direction substantially perpendicular to the arrangement direction includes a circular-arc-shaped portion that is formed inside the circular-arc-shaped side wall portion into a shape substantially equivalent to the shape formed by the circular-arc-shaped side wall portion as viewed in the arrangement direction, and has a smaller cross section in the direction substantially perpendicular to the arrangement direction than a corresponding cross section of the shape formed by the circular-arc-shaped side portion, the cross-sectional shape of the displacement portion in the direction substantially perpendicular to the arrangement direction further includes a linear portion that is formed inside the linear side wall portions into a shape substantially equivalent to the shape formed by the linear side wall portions as viewed in the arrangement direction, and has a smaller cross section in the direction substantially perpendicular to the arrangement direction than a corresponding cross section of the shape formed by the linear side portions, and the electrode connection portion is connected to the linear portion on the side opposite to the circular-arc-shaped portion in such a position as to overlap with a side wall portion of the pressure chamber in the arrangement direction.

An invention of claim 2 is the inkjet head according to claim 1, wherein an electrode portion is disposed on the piezoelectric device on the side opposite to the pressure chamber, voltage applied to the electrode portion at the time of displacement of the piezoelectric device, and the electrode portion has a shape substantially equivalent to the shape of the piezoelectric device.

An invention of claim 3 is the inkjet head according to claim 2, wherein the size of the electrode portion is substantially equivalent to or smaller than the size of the piezoelectric device.

An invention of claim 4 is the inkjet head according to any one of claims 1 to 3, wherein the electrode connection portion includes a connection portion body electrically connected with the electrode, and a junction portion so joined as to connect the connection portion body and the displacement portion, and the junction portion is disposed in such a position as to overlap with the linear side wall portions in the arrangement direction.

An invention of claim 5 is the inkjet head according to claim 4, wherein a width of the junction portion in the direction substantially perpendicular to the arrangement direction is substantially equivalent to or smaller than a width of the connection portion body in the direction substantially perpendicular to the arrangement direction.

An invention of claim 6 is the inkjet head according to any one of claims 1 to 5, wherein the thickness of the piezoelectric device in the arrangement direction is 100 μm or smaller.

An invention of claim 7 is the inkjet head according to any one of claims 1 to 6 further including: a supply channel connected to the circular-arc-shaped side wall portion on the side opposite to the linear side wall portions, and forming a channel through which liquid is supplied to the pressure chamber, wherein a width of the supply channel in the direction substantially perpendicular to the arrangement direction is smaller than the corresponding width of the pressure chamber, and the supply channel is so disposed as to intersect at an angle within a predetermined range with a straight line passing through the center of the pressure chamber and ends of the linear side wall portions on the side opposite to the circular-arc-shaped side wall portion.

An invention of claim 8 is the inkjet head according to any one of claims 1 to 7, wherein the nozzle hole communicates with the side opposite the supply side of the linear side wall portions.

Advantageous Effects of Invention

According to the present invention, improvement of drive efficiency of a piezoelectric device, and reduction of fracture fatigue of the piezoelectric device are both achievable.

BRIEF DESCRIPTION OF DRAWINGS

FIG. 8 is a view showing driving voltages and stresses of the examples of the piezoelectric device and the pressure chamber.

DESCRIPTION OF EMBODIMENTS

An embodiment according to the present invention is hereinafter described with reference to the drawings.

Figure 1:
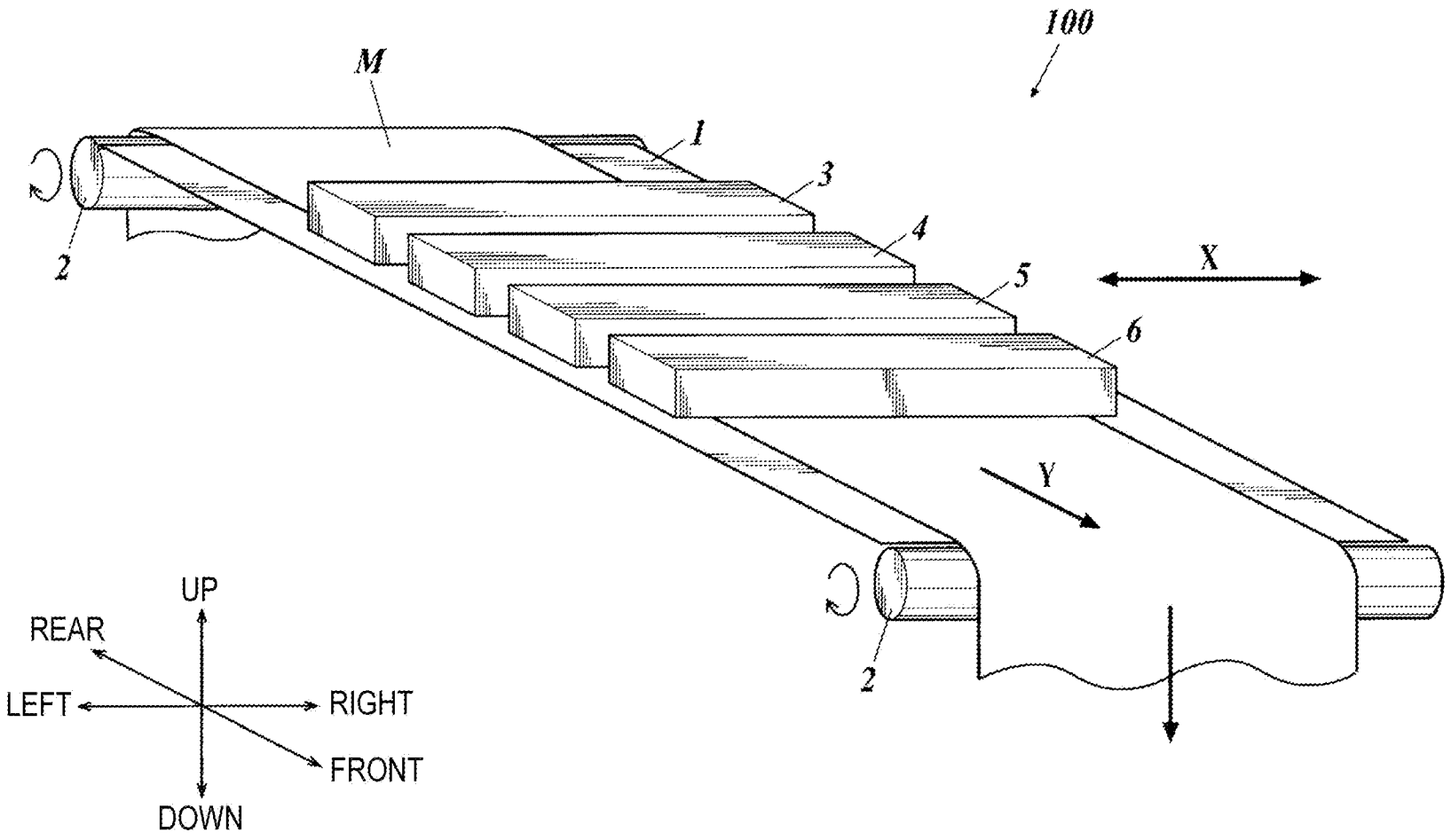
FIG. 1 is a perspective view illustrating a general configuration of an inkjet recording apparatus according to an embodiment of the present invention.

FIG. 1 is a perspective view illustrating a general configuration of an inkjet recording apparatus 100 according to the present invention.

As illustrated in FIG. 1, the inkjet recording apparatus 100 includes a platen 1 supporting a recording medium M, conveyance rollers 2 provided before and behind the platen 1 to convey the recording medium M, and a predetermined number of (such as four) line heads 3, 4, 5, and 6 provided above the platen 1.

In the following description, a conveyance direction of the recording medium M corresponds to the front-rear direction (or Y direction), a direction crossing the front-rear direction at right angles corresponds to the left-right direction (or X direction), and a direction crossing the front-rear direction and the left-right direction at right angles corresponds to the up-down direction.

Each of the line heads 3, 4, 5, and 6 has a long shape extending in the left-right direction. The line heads 3, 4, 5, and 6 are arranged in the direction from the upstream side to the downstream side with a predetermined clearance left between each other.

The inkjet recording apparatus 100 conveys the recording medium M supported by the platen 1 in the conveyance direction in accordance with drive of the conveyance rollers 2. During this period, ink in respective process colors of Y, M, C, and K are ejected to the recording medium M from the line heads 3, 4, 5, and 6, respectively.

The respective line heads 3, 4, 5, and 6 have substantially the same structure except for different colors of ink to be ejected. The line head 3 is hereinafter described in detail as a typical example of the respective line heads.

Figure 2:
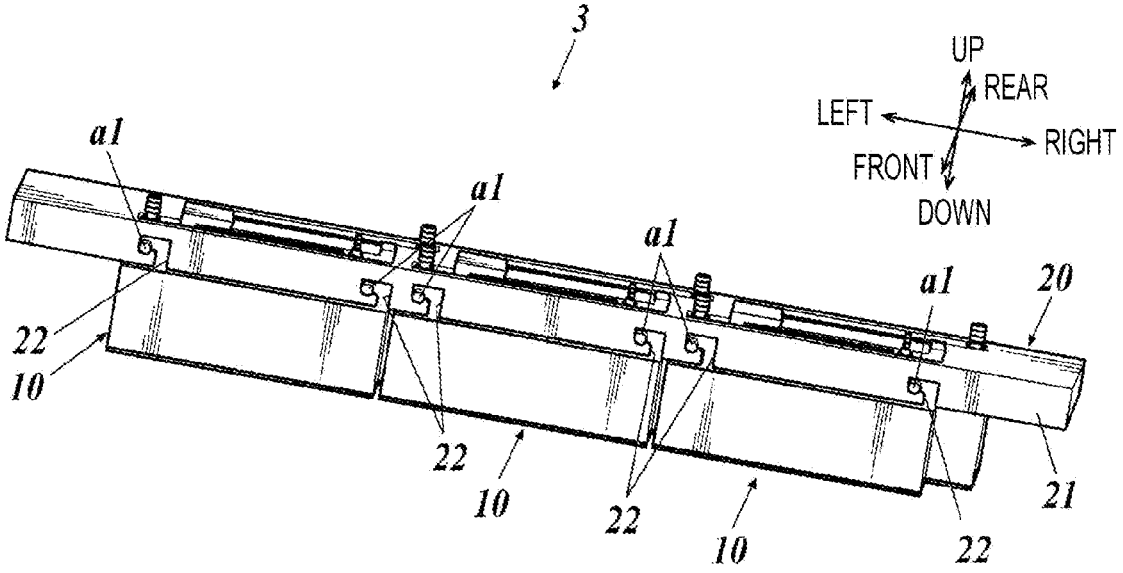
FIG. 2 is a perspective view illustrating a general configuration of a line head included in the inkjet recording apparatus.

FIG. 2 is a perspective view illustrating a general configuration of the line head 3.

As illustrated in FIG. 2, the line head 3 includes a predetermined number of (such as three) inkjet heads 10 arranged in the left-right direction, and a frame unit (support) 20 for supporting the inkjet heads 10.

The frame unit 20 is a component extended long in the left-right direction, and having a box shape opened downward. A predetermined number of (such as six for each surface) grooves 22 are formed at predetermined positions of each of a front surface 21 and a rear surface of the frame unit 20. The grooves 22 engage with projections a1 and a2 formed on the front surface side and the rear surface side, respectively, of a housing 30 of the inkjet heads 10.

The plurality of grooves 22 are formed with predetermined clearances left between the respective grooves 22, in correspondence with clearances left between the respective projections a1 on the front surface side, and between the respective projections a2 on the rear surface side.

Each of the grooves 22 is a notch cut from the lower end of the front surface 21 or the rear surface, and has a shape bended substantially at right angles as viewed in the front-rear direction. The deepest portion of each of the grooves 22 is curved in a circular-arc and downwardly convex shape, so that the cylindrical projections a1 and a2 can be placed at the circular-arc-shaped portions of the grooves 22.

FIG. 2 and other figures illustrate only the grooves 22 formed in the front surface 21.

Openings are formed in an upper surface of the frame unit 20 in correspondence with the respective inkjet heads 10. Supply connectors 15, a discharge connector 16, electric connectors 19 (described later) and others constituting the inkjet heads 10 are inserted through each of the openings of the frame unit 20.

The inkjet heads 10 are hereinafter detailed.

Figure 3A:
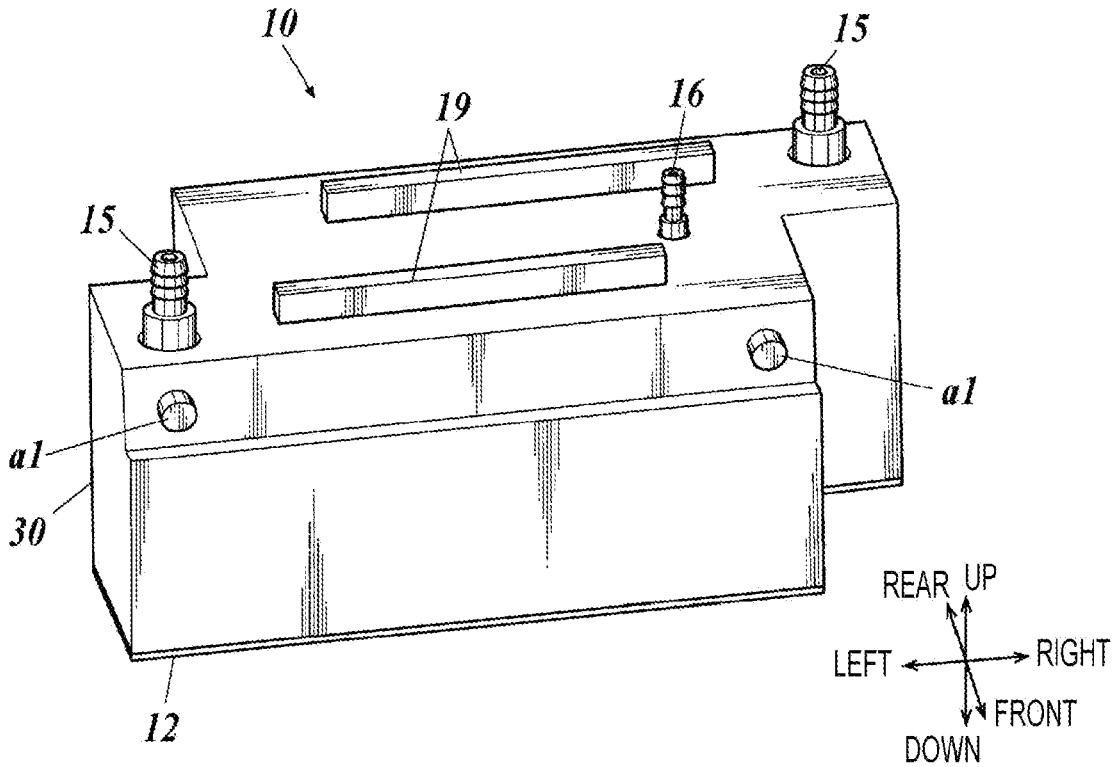
FIG. 3A is a perspective view illustrating a general structure of an inkjet head constituting the line head.
Figure 3B:
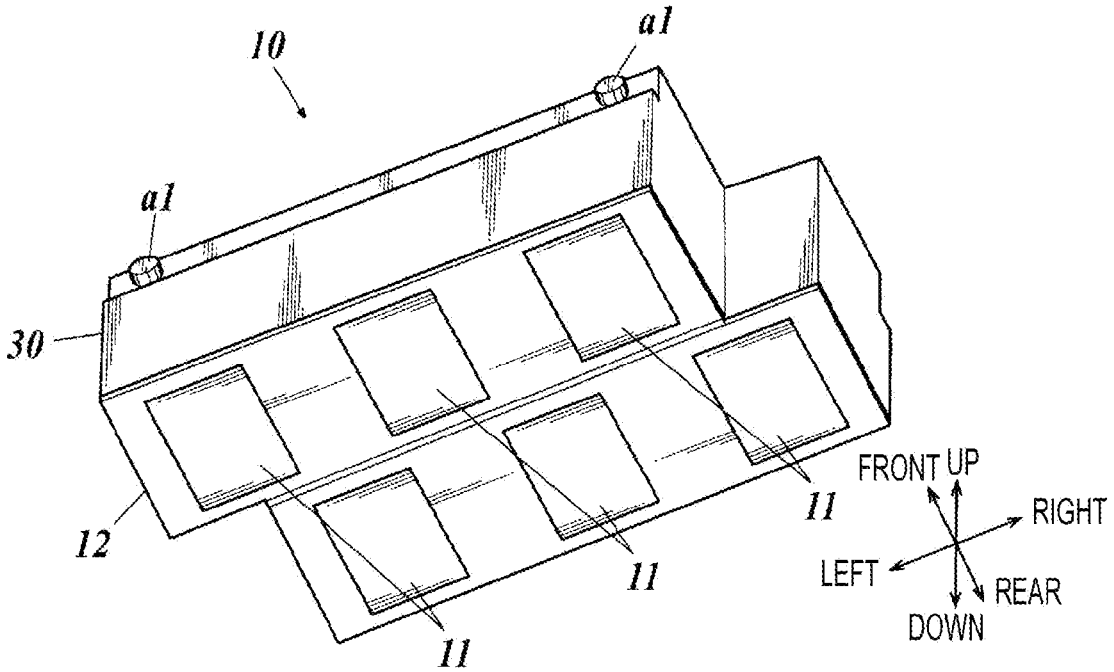
FIG. 3B is a perspective view illustrating a general structure of the inkjet head constituting the line head.
Figure 4:
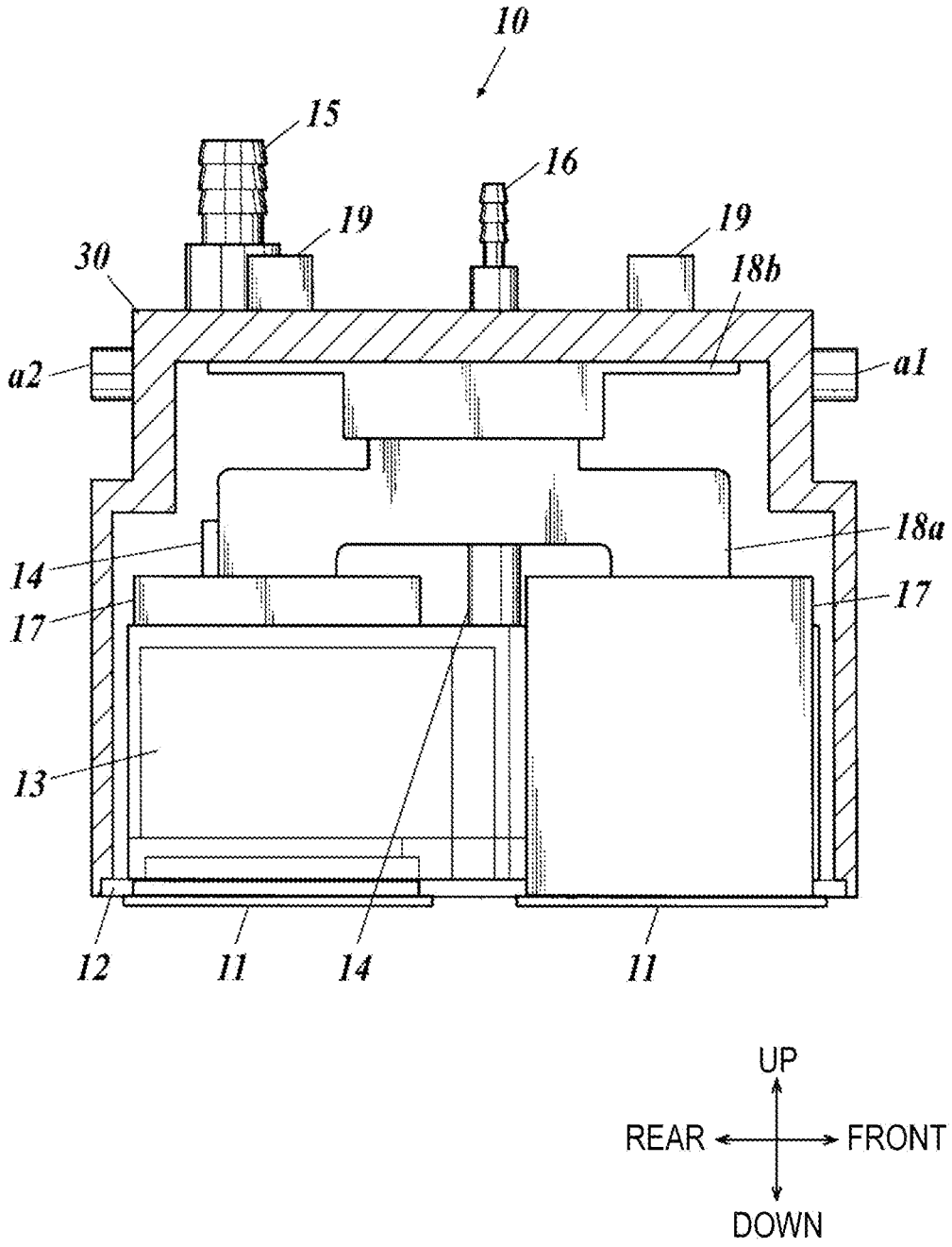
FIG. 4 is a view schematically illustrating an internal configuration of the inkjet head.

FIGS. 3A and 3B are perspective views illustrating a general configuration of one of the inkjet heads 10. FIG. 4 is a view schematically illustrating an internal configuration of one of the inkjet heads 10.

As illustrated in FIGS. 3A and 3B and FIG. 4, the inkjet head 10 includes a holding plate 12 for holding a predetermined number of (such as six) head chips 11, an ink chamber 13 provided common to the respective head chips 11 to supply ink to the head chips 11, the supply connectors 15 and the discharge connector 16 communicating with the ink chamber 13 via supply pipes 14, IC substrates 17 for controlling drive of piezoelectric devices 114*b* (described later) of the head chips 11, the electric connectors 19 connected with the IC substrates 17 via a relay substrate 18*a* and a connector substrate 18*b* and connected with a control substrate (not shown) on the recording apparatus body side, and the housing 30 accommodating these head constituent parts.

The two supply connectors 15, the two IC substrates 17, and the two electric connectors 19 are provided both for the set of three head chips 11 disposed on the front side of the holding plate 12, and for the set of three head chips 11 disposed on the rear side of the holding plate 12, as will be detailed below.

The holding plate 12 is attached and fixed to a lower end of the housing 30.

The predetermined number of (such as six) head chips 11, each of which includes a nozzle substrate 111 having substantially uniform shape and size, are disposed on the holding plate 12 in a zigzag shape in the left-right direction. More specifically, the three head chips 11 disposed with a predetermined uniform clearance left between each other are provided on each of the front side and the rear side of the holding plate 12. The three head chips 11 on the front side and the three head chips 11 on the rear side are shifted from the opposite side in the left-right direction by a length equivalent to the width of the one head chip 11 in the left-right direction. The holding plate 12 has a stepped shape in correspondence with the arrangement of the predetermined number of (such as six) of the head chips 11.

Each of the head chips 11 is a plate-shaped component containing a plurality of nozzles 111*a*.

The head chips 11 are hereinafter detailed.

Figure 5:
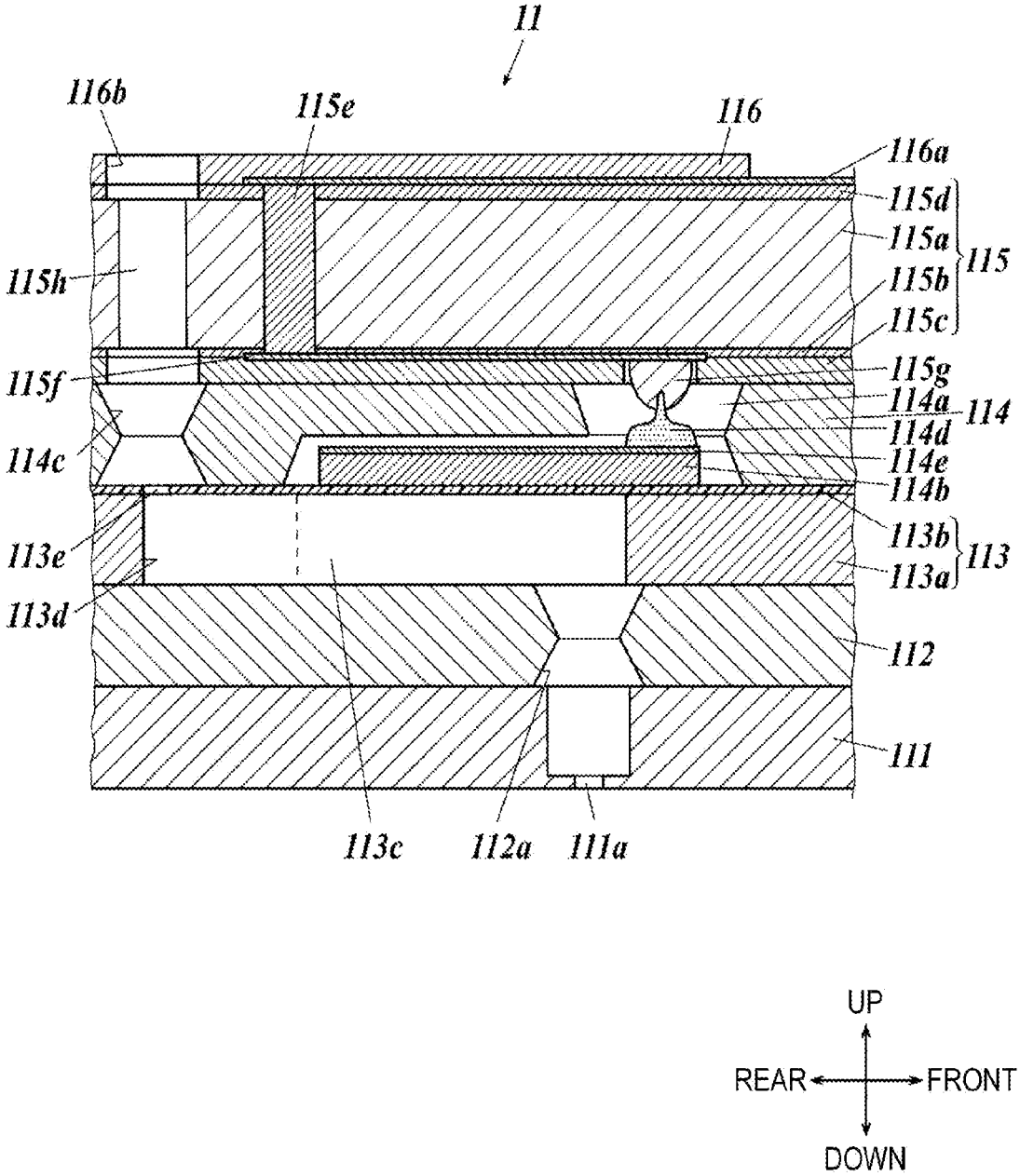
FIG. 5 is a partial cross-sectional view illustrating a general structure of a head chip included in the inkjet head.
Figure 6:
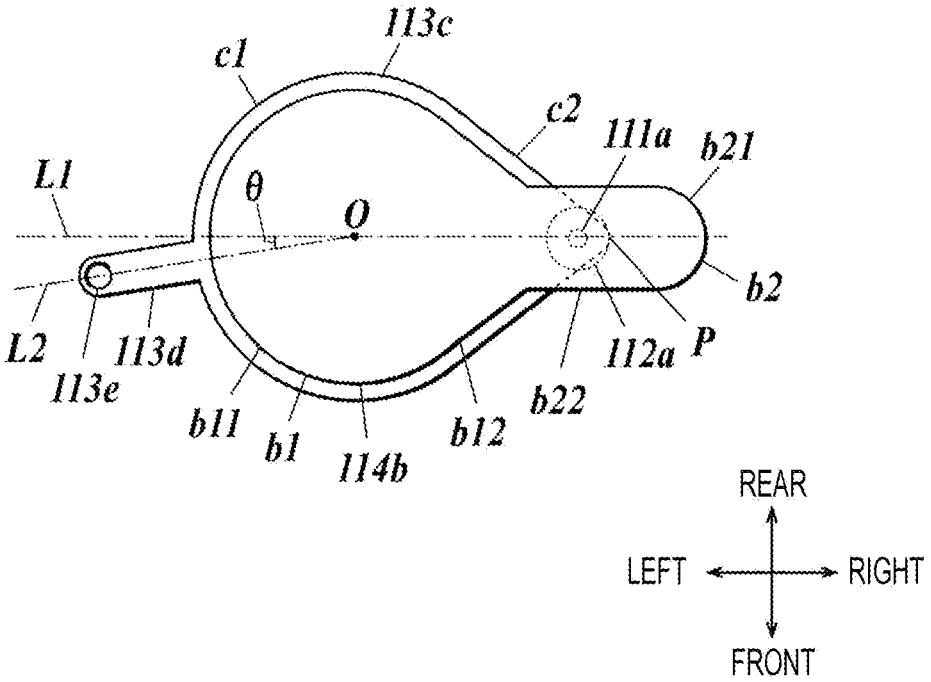
FIG. 6 is a plan view schematically illustrating arrangement of a nozzle, a piezoelectric device, and a pressure chamber constituting the head chip.

FIG. 5 is a partial cross-sectional view illustrating a general configuration of one of the head chips 11, showing only constituent elements associated with one of the nozzles 111*a*. FIG. 6 is a plan view schematically illustrating arrangement of the nozzle 111*a*, the piezoelectric device 114*b*, and a pressure chamber 113*c*.

As illustrated in FIG. 5, the head chip 11 includes the nozzle substrate 111, an intermediate substrate 112, a pressure chamber substrate 113, a first bonding layer 114, a wiring layer 115, and a second bonding layer 116. The respective components 111 to 116 are laminated in this order.

The nozzle substrate 111 is a substrate made of silicon, and positioned on the lowermost layer of the head chip 11. The plurality of nozzles 111*a* are formed in the nozzle substrate 111.

The nozzles 111*a* are arranged in a nozzle surface substantially in matrix, for example.

The intermediate substrate 112 is a substrate made of glass, and laminated on and joined to the upper surface of the nozzle substrate 111. A through hole 112*a* communicating with the corresponding nozzle 111*a* of the nozzle substrate 111 is formed in the intermediate substrate 112.

The pressure chamber substrate 113 is constituted by a pressure chamber layer 113*a* and an oscillation plate 113*b*.

The pressure chamber layer 113*a* is a substrate made of silicon, and laminated on and joined to the upper surface of the intermediate substrate 112. A pressure chamber 113*c* is formed in the pressure chamber layer 113*a* in such a shape as to penetrate the pressure chamber layer 113*a*. The pressure chamber 113*c* applies ejection pressure to ink ejected from the nozzle 111*a*.

The pressure chamber 113*c* provided above the through hole 112*a* and the nozzle 111*a* communicates with the through hole 112*a* and the nozzle 111*a*. A communication hole 113*d* is formed in such a shape as to extend in the horizontal direction in the pressure chamber layer 113*a*. The communication hole 113*d* produces a channel for ink supplied to the pressure chamber.

The configurations of the pressure chamber 113*c* and the communication hole 113*d* are hereinafter detailed.

The pressure chamber 113*c* achieves a displacement in accordance with deformation of the oscillation plate 113*b* produced by drive of the piezoelectric device 114*b* to apply ejection pressure to ink for ejection from the nozzle 111*a*. More specifically, as illustrated in FIG. 6, the pressure chamber 113*c* includes a circular-arc-shaped side wall portion c1 constituted by a substantially circular-arc-shaped side wall portion in the plan view, and linear side wall portions c2 constituted by substantially linear side wall portions in the plan view.

The circular-arc-shaped side wall portion c1 is provided on the ink supply side of the pressure chamber 113*c*. More specifically, the circular-arc-shaped side wall portion c1 connects with the downstream side end of the communication hole 113*d* in the ink supply direction to make junction with the communication hole (supply channel) 113*d* which forms a channel for ink supplied to the pressure chamber 113*c*. A cross section of the circular-arc-shaped side wall portion c1 crossing the up-down direction (arrangement direction of the pressure chamber and the piezoelectric device) substantially at right angles is substantially semicircular.

The linear side wall portions c2 are connected with two ends of the circular-arc-shaped side wall portion c1 on the side opposite to the ink supply side of the circular-arc-shaped side wall portion c1, i.e., the communication hole 113*d* side.

The linear side wall portions c2 form a tapered shape where the distance between the linear side wall portions c2 in the front-rear direction substantially perpendicular to the up-down direction gradually decreases toward the side opposite to the ink supply side, i.e., the communication hole 113*d* side. More specifically, the two side wall portions constituting the linear side wall portions c2 cross each other at a predetermined angle (such as 90°) on the downstream side in the ink supply direction, and form a shape linearly symmetric with respect to a straight line (chain line L1 in FIG. 6) passing through a center O of the pressure chamber and an end P at which the two side wall portions constituting the linear side wall portions c2 cross each other. The through hole 112*a* communicating with the nozzle 111*a* is connected with the portion at which the two side wall portions constituting the linear side wall portions c2 cross each other. In other words, the nozzle hole communicates with the side opposite to the ink supply side of the linear side wall portions c2 via the through hole 112*a*.

The angle at which the two side wall portions constituting the linear side wall portions c2 is only presented by way of example, and not limited to this specific example. It is therefore intended that this angle may be arbitrarily varied.

The length ratio of each of the linear side wall portions c2 to the circular-arc-shaped side wall portion c1 in the left-right direction may be arbitrarily varied. However, in consideration of stress convergence and displacement inhibition of the piezoelectric device 114*b* provided immediately above the pressure chamber 113*c*, it is preferable that each of the linear side wall portions c2 is relatively longer than the circular-arc-shaped side wall portion c1. More specifically, it is preferable that the distance between the center O of the pressure chamber 113*c* and the end P at which the two side wall portions constituting the linear side wall portions c2 cross each other becomes longer than the radial length between the center O of the pressure chamber 113*c* and the circular-arc-shaped side wall portion c1.

The communication hole 113*d* connects with the circular-arc-shaped side wall portion c1 on the side opposite to the linear side wall portions c2, and has a substantially cylindrical shape, for example.

The width of the communication hole 113*d* in the direction substantially perpendicular to the up-down direction is smaller than the corresponding width of the pressure chamber 113*c*. The communication hole 113*d* is so disposed as to cross the straight line (chain line L1 in FIG. 6) at an angle within a predetermined range (such as approximately ±10°), i.e., to intersect at an angle in this range with the straight line passing through the center O of the pressure chamber 113*c* and the end P at which the two side wall portions constituting the linear side wall portions c2 cross each other. In other words, a straight line (two-dot chain line L2 in FIG. 6) extending in the extension direction of the communication hole 113*d* intersects at an angle θ with the chain line L1 passing through the end P at which the two side wall portions constituting the linear side wall portions c2 cross each other. This angle θ lies within the predetermined range.

It is considered as a preferable configuration that the two-dot chain line L2 extending in the extension direction of the communication hole 113*d*, and the chain line L1 passing through the end P at which the two side wall portions constituting the linear side wall portions c2 extend substantially in the same direction in view of reduction of residual ink and lowering of the survival degree of bubbles. However, it is preferable that these two lines cross each other at the angle θ within the predetermined range in view of increase in the degree of freedom in positioning the nozzle 111*a*.

The communication hole 113*d* is formed integrally with the pressure chamber 113*c*. Accordingly, the layer structure of the head chip 11 becomes simpler, and the cost of the inkjet head 10 lowers.

The oscillation plate 113*b* is laminated on and joined to the upper surface of the pressure chamber layer 113*a* in such a shape as to cover the opening of the pressure chamber 113*c*. In other words, the oscillation plate 113*b* constitutes an upper wall portion of the pressure chamber 113*c*. An oxide film is formed on the surface of the oscillation plate 113*b*. A through hole 113*e* communicating with the communication hole 113*d* is formed in the oscillation plate 113*b*.

The first bonding layer 114 is laminated on the upper surface of the oscillation plate 113*b*. The first bonding layer 114 functions as a photosensitive resin layer which bonds the oscillation plate 113*b* and the wiring layer 115, and as a partitioning layer which contains a space 114*a*. The space 114*a* is formed above the pressure chamber 113*c* in such a shape as to penetrate the first bonding layer 114, and accommodates the piezoelectric device 114*b*.

The configuration of the piezoelectric device 114*b* is now detailed.

The piezoelectric device 114*b* is disposed at a position facing to the pressure chamber 113*c* with the oscillation plate 113*b* interposed between the piezoelectric device 114*b* and the pressure chamber 113*c*. The piezoelectric device 114*b* is an actuator constituted by PZT (lead zirconium titanate) which deforms the oscillation plate 113*b*.

The piezoelectric device 114*b* has a thin shape having a thickness of 100 μm or smaller in the up-down direction, for example.

The piezoelectric device 114*b* includes a displacement portion b1 having a substantially the same shape as the shape of the pressure chamber 113*c*, and an electrode connection portion b2 electrically connecting the piezoelectric device 114*b* and a conductive substrate 115*f* (described later) of the wiring layer 115.

The displacement portion b1 deforms the oscillation plate 113*b* by displacement of the displacement portion b1 to cause a pressure change inside the pressure chamber 113*c*. More specifically, as illustrated in FIG. 6, the displacement portion b1 includes a circular-arc-shaped portion b11 disposed inside the circular-arc-shaped side wall portion c1 of the pressure chamber 113*c*, and having substantially the same shape as the shape formed by the circular-arc-shaped side wall portion c1 as viewed in the up-down direction. The displacement portion b1 further includes a linear portion b12 disposed inside the linear side wall portions c2, and having substantially the same shape as the shape formed by the linear side wall portions c2 as viewed in the up-down direction.

The circular-arc-shaped portion b11 has a substantially semicircular shape having a smaller cross section crossing the up-down direction (arrangement direction of the pressure chamber 113*c* and the piezoelectric device 114*b*) substantially at right angles than a corresponding cross section of the shape formed by the circular-arc-shaped side wall portion c1. The circular-arc-shaped portion b11 is disposed in such a position as to overlap with the circular-arc-shaped side wall portion c1 with approximate concentricity.

The linear portion b12 is connected with the circular-arc-shaped portion b11 on the electrode connection portion b2 side. The linear portion b12 has a shape having a smaller cross section crossing the up-down direction substantially at right angles than a corresponding cross section of the shape formed by the linear side wall portions c2. The linear portion b12 is tapered so that the length in the front-rear direction substantially perpendicular to the up-down direction gradually decreases toward the side opposite to the circular-arc-shaped portion b11, in a manner substantially similar to the shape formed by the linear side wall portions c2. The electrode connection portion b2 is joined to the end of the linear portion b12 on the side opposite to the circular-arc-shaped portion b11.

The electrode connection portion b2 is drawn in the right direction from the end of the linear portion b12 of the displacement portion b1. More specifically, as illustrated in FIG. 6, the electrode connection portion b2 includes a connection portion body b21 electrically connected with the conductive substrate 115*f*, and a junction portion b22 joined in such a shape as to connect the connection portion body b21 and the displacement portion b1.

The electrode connection portion b2 is disposed on the upper side in such a position as to overlap with the side wall portion of the pressure chamber 113*c* in the up-down direction. More specifically, the junction portion b22 of the electrode connection portion b2 is disposed on the upper side in such a position as to overlap with the linear side wall portions c2 in the up-down direction.

The width of the junction portion b22 in the front-rear direction substantially perpendicular to the up-down direction is smaller than the width of the displacement portion b1 in the front-rear direction, and substantially equivalent to the width of the connection portion body b21 in the front-rear direction. This structure further decreases the boundary area between the displacement portion b1 and the junction portion b22. According to this structure, the junction portion b22 is adjustable to a position away from the center of the pressure chamber 113*c*, i.e., the center of the displacement portion b1 of the piezoelectric device 114*b* by adjustment of the length ratio of each of the linear side wall portions c2 of the pressure chamber 113*c* to the circular-art-shaped side wall portion c1 in the left-right direction for reduction of stress convergence and displacement inhabitation at the boundary area between the displacement portion b1 and the junction portion b22.

The width of the junction portion b22 in the front-rear direction may be smaller than the width of the connection portion body b21 in the front-rear direction.

An upper electrode portion 114*e* is provided on the upper surface of the piezoelectric device 114*b*. On the other hand, a lower electrode portion (not shown) connected with the oscillation plate 113*b* is provided on the lower surface of the piezoelectric device 114*b*.

When voltage is applied between the upper electrode portion 114*e* and the lower electrode portion, the piezoelectric device 114*b* sandwiched between the upper electrode portion 114*e* and the lower electrode portion is deformed together with the oscillation plate 113*b*. As a result, ink contained in the pressure chamber 113*c* is pushed out and ejected from the nozzle 111*a*.

The upper electrode portion 114*e* may have a shape substantially equivalent to the shape of the piezoelectric device 114*b*, i.e., the shape of the displacement portion b1 and the electrode connection portion b2. This structure allows processing of the piezoelectric device 114*b* and the first bonding layer 114 by using an identical mask. In this case, the manufacturing step becomes easier, and the cost of the inkjet head 10 lowers.

The size of the upper electrode portion 114*e* (particularly the width in the front-rear direction) may be substantially equivalent to the size of the body of the piezoelectric device 114*b*, or smaller than this size. This structure further decreases the boundary area between the junction portion b22 and the displacement portion b1 corresponding to the displacement position of the piezoelectric device 114*b*.

A through hole 114*c* communicating with the through hole 113*e* of the oscillation plate 113*b* is formed in the first bonding layer 114 independently from the space 114*a*.

The wiring layer 115 includes an interposer 115*a* constituted by a silicon substrate. The lower surface of the interposer 115*a* is coated with two insulation layers 115*b* and 115*c* made of silicon oxide, while the upper surface of the interposer 115*a* is coated with an insulation layer 115*d* similarly made of silicon oxide. The insulation layer 115*c* corresponding to the lower one of the two insulation layers 115*b* and 115*c* is laminated on and joined to the upper surface of the first bonding layer 114.

A through electrode 115*e* is provided in such a shape as to penetrate the interposer 115*a* in the up-down direction. One end of the conductive substrate 115*f* extending in the horizontal direction is connected with the lower end of the through electrode 115*e*. A stud bump 114*d* is provided on the upper electrode portion 114*e* formed on the upper surface of the piezoelectric device 114*b*, and connected with the other end of the conductive substrate 115*f* via solder 115*g* exposed to the interior of the space 114*a*. At the time of displacement of the piezoelectric device 114*b*, voltage is applied between the upper electrode portion 114*e* and the lower electrode portion (not shown) via the conductive substrate 115*f*, the solder 115*g*, and the stud bump 114*d*.

More specifically, the conductive substrate 115*f* is disposed on the piezoelectric device 114*b* on the side opposite to the pressure chamber 113*c* to constitute an electrode electrically connected with the piezoelectric device 114*b*.

The conductive substrate 115*f* is protected between the two insulation layers 115*b* and 115*c* located below the interposer 115*a*.

An inlet 115*h* communicating with the through hole 114*c* of the first bonding layer 114 is provided in the interposer 115*a* in such a shape as to penetrate the interposer 115*a* in the up-down direction.

The second bonding layer 116 is laminated on and joined to the upper surface of the insulation layer 115*d* of the interposer 115*a* in such a position as to cover wiring 116*a* provided on the upper surface of the wiring layer 115. The second bonding layer 116 functions as a photosensitive resin layer which bonds the holding plate 12 and the head chip 11, and as a protection layer for protecting the wiring 116*a*. The wiring 116*a* extends in the horizontal direction. One end of the wiring 116*a* is connected with the upper end of the through electrode 115*e*, while the other end of the wiring 116*a* is connected with the electric connector 19 via the relay substrate 18*a* and the connector substrate 18*b*. A through hole 116*b* communicating with the inlet 115*h* is formed in the second bonding layer 116.

The communication hole 113*d*, the through holes 113*e*, 114*c*, and 116*b*, and the inlet 115*h* of the head chip 11 constitute a channel connecting the ink chamber 13 and the pressure chamber 113*c*, so that ink contained in the ink chamber 13 is supplied to the nozzle 111*a* through this channel.

Discussed hereinbelow with reference to FIGS. 7A to 7D and FIG. 8 are changes of driving voltage and internal stress produced by the difference in shapes of the pressure chamber 113*c* and the piezoelectric device 114*b*, and the difference in the presence and absence of the electrode connection portion b2.

Figure 7A:
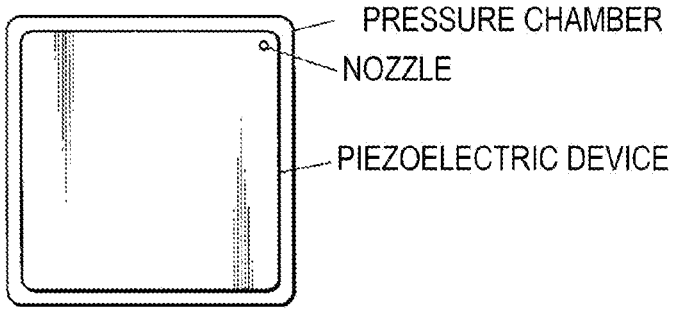
FIG. 7A is a view schematically illustrating an example of shapes of a piezoelectric device and a pressure chamber.
Figure 7B:
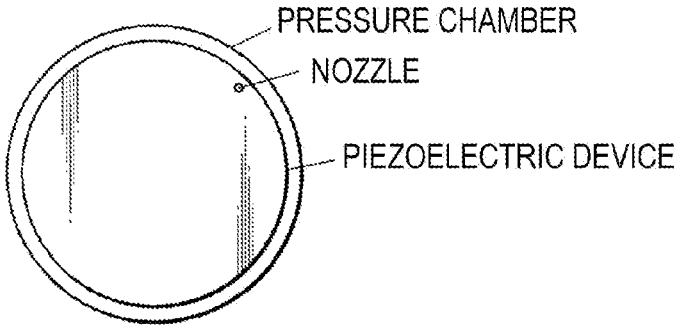
FIG. 7B is a view schematically illustrating an example of shapes of a piezoelectric device and a pressure chamber.
Figure 7C:
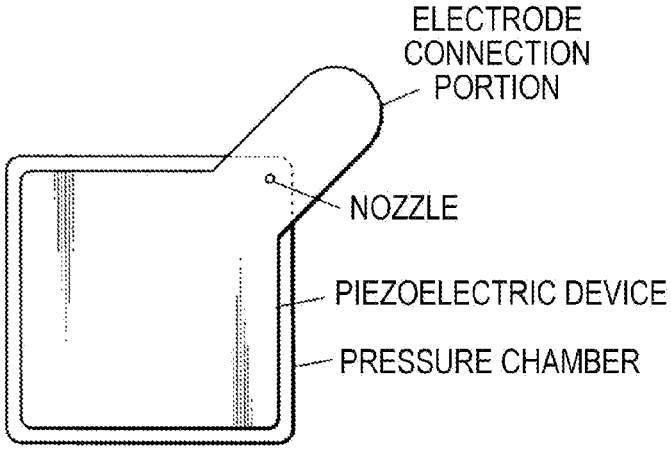
FIG. 7C is a view schematically illustrating an example of shapes of a piezoelectric device and a pressure chamber.
Figure 7D:
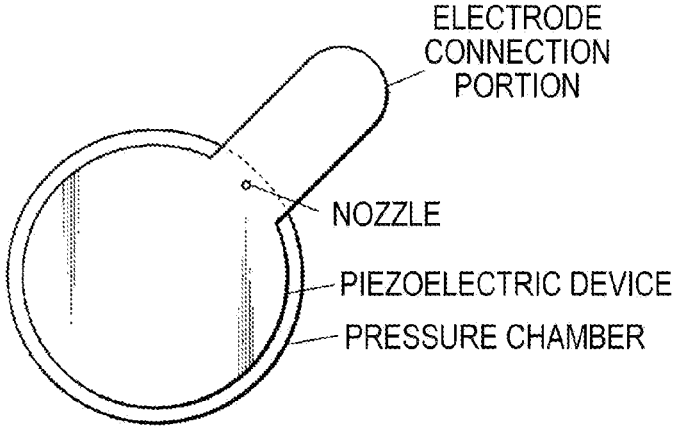
FIG. 7D is a view schematically illustrating an example of shapes of a piezoelectric device and a pressure chamber.

FIGS. 7A to 7D are views schematically illustrating examples of shapes of a piezoelectric device and a pressure chamber. FIG. 7A shows square piezoelectric device and pressure chamber not including an electrode connection portion. FIG. 7B shows circular piezoelectric device and pressure chamber not including an electrode connection portion. FIG. 7C shows square piezoelectric device and pressure chamber including an electrode connection portion drawn from the piezoelectric device. FIG. 7D shows circular piezoelectric device and pressure chamber including an electrode connection portion drawn from the piezoelectric device.

FIG. 8 is a view showing driving voltages and stresses of piezoelectric device and pressure chamber according to the present invention, and of the piezoelectric devices and pressure chambers having the shapes illustrated in FIGS. 7A to 7D.

The piezoelectric device and pressure chamber according the present invention (see FIG. 8) reflecting examinations of the driving voltage and internal stress have substantially the same main structure as that of the piezoelectric device 114*b* and pressure chamber 113*c* according to this embodiment. In this case, the ratio of each of the circular-arc-shaped portions of the piezoelectric device and piezoelectric chamber (circular-arc-shaped portion b11 and circular-arc-shaped side wall portion c1) to each of the linear portions of the piezoelectric device and piezoelectric chamber (linear portion b12 and linear side wall portions c2) is set to substantially 1 to 1.

More specifically, the circular-arc-shaped side wall portion c1 of the pressure chamber is substantially semicircular, while the linear side wall portions c2 are constituted by two side wall portions connecting with the ends of the circular-arc-shaped side wall portion c1 and crossing each other at substantially 90°.

The circular-arc-shaped portion b11 of the displacement portion of the piezoelectric device is substantially semicircular similarly to the circular-arc-shaped side wall portion c1 of the pressure chamber. The two straight lines of the linear-shaped portion b12 of the piezoelectric device are connected with the circular-arc-shaped portion b11, and extend substantially in parallel with the two straight lines of the linear side wall portions c2 of the pressure chamber. The electrode connection portion b2 is joined to the linear portion b12.

The electrode connection portion b2 is so formed as to extend substantially in the same direction as the direction of a straight line connecting the center O of the displacement portion and an intersection of assumed extension lines of the two straight lines of the linear portion b12.

The length of the pressure chamber in the portion corresponding to the diameter connecting both ends of the substantially semicircular circular-arc-shaped side wall portion c1 is 600 μm.

The length of the piezoelectric device in the portion corresponding to the diameter connecting both ends of the substantially semicircular circular-arc-shaped portion b11 is 550 μm, while the thickness of the piezoelectric device in the up-down direction is 50 μm.

The one side of the square shape of the respective piezoelectric devices illustrated in FIGS. 7A and 7C, and the diameter of the circular shape of the respective piezoelectric devices illustrated in FIGS. 7B and 7D are equalized with the length (550 μm) of the diameter of the piezoelectric device according to the present invention. Similarly, the thickness of the piezoelectric devices illustrated in FIGS. 7A to 7D in the up-down direction is equalized with the thickness (50 μm) of the piezoelectric device according to the present invention.

For calculation of each driving voltage shown in FIG. 8, voltage necessary for ejecting ink from a nozzle having a diameter of 20 μm at a predetermined speed (such as approximately 6 m/s) is calculated by using a predetermined calculation equation, and converted into a ratio to the driving voltage according to the configuration of the present invention set as a reference.

For calculation of each stress shown in FIG. 8, stress at a predetermined position of the piezoelectric device when ink is ejected from the nozzle at a predetermined speed (such as approximately 6 m/s) is calculated by using a predetermined calculation equation, and converted into a ratio to the stress according to the configuration of the present invention set as a reference. Specific positions for stress calculation are a position overlapping with the end P at which the two side wall portions constituting the linear side wall portions c2 cross each other in case of the structure according to the present invention, a corner of the piezoelectric device at which the nozzle is disposed in case of the structure illustrated in FIG. 7A, a position lying on the circumference of the piezoelectric device and crossing a straight line which passes through the center of the piezoelectric device and the nozzle in case of the structure illustrated in FIG. 7B, a position at which the electrode connection portion of the piezoelectric device overlaps with the corner of the pressure chamber where the nozzle is disposed in case of the structure illustrated in FIG. 7C, and a position lying on the circumference of the pressure chamber and overlapping with the electrode connection portion of the piezoelectric device in case of the structure illustrated in FIG. 7D.

When the piezoelectric device containing no electrode connection portion is overlapped inside the pressure chamber with approximate concentricity, it is considered as advantageous that the piezoelectric device and the pressure chamber are circular in view of driving efficiency as can be seen from FIG. 8.

On the other hand, when the piezoelectric device contains the electrode connection portion, the effect of displacement inhibition (stress) produced by the presence of the electrode connection portion is smaller for the substantially square piezoelectric device than for the substantially circular piezoelectric device. More specifically, in case of the substantially circular piezoelectric device, the distances between the center of the piezoelectric device and respective points on the circumference thereof are substantially uniform. Accordingly, when the electrode connection portion is drawn from the circumference of the piezoelectric device, the displacement and stress sharply change at the boundary area between the electrode connection portion and the piezoelectric device. On the other hand, when the electrode connection portion is drawn from a corner of the substantially square piezoelectric device, the distances between the center of the piezoelectric device and respective points on two sides which constitute the portion drawn to form the electrode connection portion of the piezoelectric device and cross each other substantially at right angles increase in the direction toward the electrode connection portion, in which condition the displacement and stress smoothly change. In addition, the boundary area between the displacement portion of the piezoelectric device and the electrode connection portion comes to the position farthest from the center of the piezoelectric device. Accordingly, the effect of displacement inhibition is considered to become the minimum at that position.

According to the inkjet head 10 in this embodiment as described herein, the cross-sectional shape of the pressure chamber 113*c* crossing the up-down direction substantially at right angles includes the circular-arc-shaped side wall portion c1 having a substantially circular-arc shape on the upstream side in the ink supply direction, and the linear side wall portions c2 so shaped that the distance between the linear side wall portions c2 decreases toward the side opposite to the upstream side in the ink supply direction, i.e., on the side where the nozzle hole is formed. The piezoelectric device 114*b* includes the displacement portion b1 which produces a pressure change inside the pressure chamber 113*c* by displacement of the displacement portion b1, and the electrode connection portion b2 electrically connecting the piezoelectric device 114*b* and the conductive substrate 115*f*. The cross-sectional shape of the displacement portion b1 taken in a direction substantially perpendicular to the up-down direction includes the circular-arc-shaped portion b11 formed inside the circular-arc-shaped side wall portion c1 into a shape substantially equivalent to the shape formed by the circular-arc-shaped portion c1 as viewed in the up-down direction, and having a smaller cross section in a direction substantially perpendicular to the up-down direction than the cross section of the circular-arc-shaped side wall portion c1. The cross-sectional shape of the displacement portion b1 further includes the linear portion b12 which connects with the circular-arc-shaped portion b11 and has a shape formed inside the linear side wall portions c2 into a shape substantially equivalent to the shape formed by the linear side wall portions c2 as viewed in the up-down direction, and having a smaller cross section in a direction substantially perpendicular to the up-down direction than the cross section of the shape formed by the linear side wall portions c2. The electrode connection portion b2 connects with the linear portion b12 on the side opposite to the circular-arc-shaped portion b11, and so disposed as to overlap with the side wall portion of the pressure chamber 113*c* in the up-down direction. This structure reduces convergence of stress applied to the boundary area between the displacement portion b1 of the piezoelectric device 114*b* and the electrode connection portion b2 while maintaining the durability against pressure applied to connect the piezoelectric device 114*b* and the conductive substrate 115*f*. Particularly, the structure of the piezoelectric device 114*b* and the pressure chamber 113*c* discussed above reduces convergence of stress to the boundary area between the displacement portion b1 of the piezoelectric device 114*b* and the electrode connection portion b2 even in case of the piezoelectric device 114*b* which is thin and easily produces a large displacement, such as the piezoelectric device 114*b* having a thickness of 100 μm or smaller in the up-down direction.

Accordingly, improvement of the driving efficiency of the piezoelectric device 114*b* and reduction of fatigue fracture of the piezoelectric device 114*b* are both achievable.

Moreover, the junction portion b22 so joined as to connect the displacement portion b1 and the connection portion body b21 of the electrode connection portion b2 electrically connected with the conductive substrate 115*f* is disposed at a position overlapped with the linear side wall portions c2 in the up-down direction. This structure also reduces sharp changes of displacement and stress applied to the connection portion body b21 of the electrode connection portion b2 provided on the side wall portion of the pressure chamber 113*c*.

The present invention is not limited to the embodiment described herein. Various improvements and design changes may be made to the embodiment without departing from the scope of the present invention.

For example, the electrode connection portion b2 which includes the junction portion b22 having a width substantially equivalent to the width of the connection portion body b21 in the direction substantially perpendicular to the up-down direction has been discussed by way of example. However, the electrode connection portion b2 is not limited to this specific example. The presence of the junction portion b22, and the shape and other conditions of the junction portion b22 may be arbitrarily determined as long as the electrode connection portion b2 electrically connects with the piezoelectric device 114*b*.

Needless to say, other specific detailed configurations and the like may be arbitrarily changed.

In addition, it should be understood that the embodiment disclosed herein is presented by way of example in all possible points, and not intended to limit the present invention in any way. The scope of the present invention is defined not by the foregoing description, but only by the appended claims. It is therefore intended that all changes within senses and ranges equivalent to the scope of the appended claims are all included in the scope of the present invention.

INDUSTRIAL APPLICABILITY

As described herein, the inkjet head according to the present invention is a useful device capable of increasing driving efficiency of a piezoelectric device while reducing fatigue fracture of the piezoelectric device.

The invention claimed is:

1. An inkjet head comprising:

a nozzle hole through which droplets are ejected;

a pressure chamber so provided as to communicate with the nozzle hole; and a piezoelectric device disposed on the side opposite to the nozzle hole, and causing a pressure change inside the pressure chamber, wherein a cross-sectional shape of the pressure chamber in a direction substantially perpendicular to an arrangement direction where the pressure chamber and the piezoelectric device are arranged includes a circular-arc-shaped side wall portion that has a substantially circular-arc shape on the supply side for liquid supply to the pressure chamber, and linear side wall portions connected with two ends of the circular-arc-shaped side wall portion on the side opposite to the supply side, and forming such a shape that the distance between the linear side wall portions gradually decreases toward the side opposite to the supply side, the piezoelectric device includes a displacement portion that causes the pressure change inside the pressure chamber by displacement of the piezoelectric device, and an electrode connection portion electrically connecting the piezoelectric device and an electrode, a cross-sectional shape of the displacement portion in the direction substantially perpendicular to the arrangement direction includes a circular-arc-shaped portion that is formed inside the circular-arc-shaped side wall portion into a shape substantially equivalent to the shape formed by the circular-arc-shaped side wall portion as viewed in the arrangement direction, and has a smaller cross section in the direction substantially perpendicular to the arrangement direction than a corresponding cross section of the shape formed by the circular-arc-shaped side portion, the cross-sectional shape of the displacement portion in the direction substantially perpendicular to the arrangement direction further includes a linear portion that is formed inside the linear side wall portions into a shape substantially equivalent to the shape formed by the linear side wall portions as viewed in the arrangement direction, and has a smaller cross section in the direction substantially perpendicular to the arrangement direction than a corresponding cross section of the shape formed by the linear side portions, and the electrode connection portion is connected to the linear portion on the side opposite to the circular-arc-shaped portion in such a position as to overlap with a side wall portion of the pressure chamber in the arrangement direction.

2. The inkjet head according to claim 1, wherein an electrode portion is disposed on the piezoelectric device on the side opposite to the pressure chamber, voltage applied to the electrode portion at the time of displacement of the piezoelectric device, and the electrode portion has a shape substantially equivalent to the shape of the piezoelectric device.

3. The inkjet head according to claim 2, wherein the size of the electrode portion is substantially equivalent to or smaller than the size of the piezoelectric device.

4. The inkjet head according to claim 3, wherein the electrode connection portion includes a connection portion body electrically connected with the electrode, and a junction portion so joined as to connect the connection portion body and the displacement portion, and the junction portion is disposed in such a position as to overlap with the linear side wall portions in the arrangement direction.

5. The inkjet head according to claim 3, wherein the thickness of the piezoelectric device in the arrangement direction is 100 μm or smaller.

6. The inkjet head according to claim 3 further comprising:

a supply channel connected to the circular-arc-shaped side wall portion on the side opposite to the linear side wall portions, and forming a channel through which liquid is supplied to the pressure chamber, wherein a width of the supply channel in the direction substantially perpendicular to the arrangement direction is smaller than the corresponding width of the pressure chamber, and the supply channel is so disposed as to intersect at an angle within a predetermined range with a straight line passing through the center of the pressure chamber and ends of the linear side wall portions on the side opposite to the circular-arc-shaped side wall portion.

7. The inkjet head according to claim 3, wherein the nozzle hole communicates with the side opposite the supply side of the linear side wall portions.

8. The inkjet head according to claim 2, wherein the electrode connection portion includes a connection portion body electrically connected with the electrode, and a junction portion so joined as to connect the connection portion body and the displacement portion, and the junction portion is disposed in such a position as to overlap with the linear side wall portions in the arrangement direction.

9. The inkjet head according to claim 2, wherein the thickness of the piezoelectric device in the arrangement direction is 100 μm or smaller.

10. The inkjet head according to claim 2 further comprising:

a supply channel connected to the circular-arc-shaped side wall portion on the side opposite to the linear side wall portions, and forming a channel through which liquid is supplied to the pressure chamber, wherein a width of the supply channel in the direction substantially perpendicular to the arrangement direction is smaller than the corresponding width of the pressure chamber, and the supply channel is so disposed as to intersect at an angle within a predetermined range with a straight line passing through the center of the pressure chamber and ends of the linear side wall portions on the side opposite to the circular-arc-shaped side wall portion.

11. The inkjet head according to claim 2, wherein the nozzle hole communicates with the side opposite the supply side of the linear side wall portions.

12. The inkjet head according to claim 1, wherein the electrode connection portion includes a connection portion body electrically connected with the electrode, and a junction portion so joined as to connect the connection portion body and the displacement portion, and the junction portion is disposed in such a position as to overlap with the linear side wall portions in the arrangement direction.

13. The inkjet head according to claim 12, wherein a width of the junction portion in the direction substantially perpendicular to the arrangement direction is substantially equivalent to or smaller than a width of the connection portion body in the direction substantially perpendicular to the arrangement direction.

14. The inkjet head according to claim 13, wherein the thickness of the piezoelectric device in the arrangement direction is 100 μm or smaller.

15. The inkjet head according to claim 12, wherein the thickness of the piezoelectric device in the arrangement direction is 100 μm or smaller.

16. The inkjet head according to claim 12 further comprising:

a supply channel connected to the circular-arc-shaped side wall portion on the side opposite to the linear side wall portions, and forming a channel through which liquid is supplied to the pressure chamber, wherein a width of the supply channel in the direction substantially perpendicular to the arrangement direction is smaller than the corresponding width of the pressure chamber, and the supply channel is so disposed as to intersect at an angle within a predetermined range with a straight line passing through the center of the pressure chamber and ends of the linear side wall portions on the side opposite to the circular-arc-shaped side wall portion.

17. The inkjet head according to claim 12, wherein the nozzle hole communicates with the side opposite the supply side of the linear side wall portions.

18. The inkjet head according to claim 1, wherein the thickness of the piezoelectric device in the arrangement direction is 100 μm or smaller.

19. The inkjet head according to claim 1 further comprising:

a supply channel connected to the circular-arc-shaped side wall portion on the side opposite to the linear side wall portions, and forming a channel through which liquid is supplied to the pressure chamber, wherein a width of the supply channel in the direction substantially perpendicular to the arrangement direction is smaller than the corresponding width of the pressure chamber, and the supply channel is so disposed as to intersect at an angle within a predetermined range with a straight line passing through the center of the pressure chamber and ends of the linear side wall portions on the side opposite to the circular-arc-shaped side wall portion.

20. The inkjet head according to claim 1, wherein the nozzle hole communicates with the side opposite the supply side of the linear side wall portions.

* * * * *